US006582329B1

(12) United States Patent
Cabrera

(10) Patent No.: US 6,582,329 B1
(45) Date of Patent: Jun. 24, 2003

(54) HOOP FOR INDICATING WHEN A BASKETBALL PASSES THERETHROUGH

(76) Inventor: Edwin Cabrera, 1501 Meridel Ave., Tampa, FL (US) 33612-6031

( * ) Notice: Subject to any disclaimer, the term of this patent is extended or adjusted under 35 U.S.C. 154(b) by 0 days.

(21) Appl. No.: 09/884,546

(22) Filed: Jun. 19, 2001

(51) Int. Cl.[7] ..... A63B 63/08
(52) U.S. Cl. ..... 473/480; 273/317.3
(58) Field of Search ..... 473/480, 489, 473/485, 487, 488, 482; 273/317.3

(56) References Cited

U.S. PATENT DOCUMENTS

| | | | | | |
|---|---|---|---|---|---|
| 3,621,602 | A | * | 11/1971 | Barcus et al. | 446/491 |
| 4,013,292 | A | | 3/1977 | Cohen et al. | |
| 4,148,555 | A | | 4/1979 | Lerman | |
| 4,858,920 | A | | 8/1989 | Best | |
| 4,956,775 | A | * | 9/1990 | Klamer et al. | 473/480 |
| 5,064,195 | A | | 11/1991 | McMahan et al. | |
| 5,360,208 | A | * | 11/1994 | Fang | 473/489 |
| 5,813,928 | A | | 9/1998 | Hsieh | |
| 5,833,558 | A | | 11/1998 | Pettle | |
| 6,402,153 | B1 | * | 1/2002 | Stewart | 273/317 |

OTHER PUBLICATIONS

Electronic Shot Basketball Assembly instructions and web page. http://www.littletikes.com/pdf/4036.pdf, Nov. 1, 2000.*

* cited by examiner

*Primary Examiner*—Paul T. Sewell
*Assistant Examiner*—M. Chambers
(74) *Attorney, Agent, or Firm*—Richard L. Miller

(57) ABSTRACT

A hoop for indicating when a basketball passes therethrough that includes a ring and first and second apparatuses. In a first embodiment, the first apparatus includes a momentary microswitch, a lever that closes the microswitch when contacted by the basketball, and a timer that activates when the momentary switch is closed. In a second embodiment, the first apparatus includes a light source and a photo electric cell that receives a beam of light from the light source. When the beam of light is broken by the basketball, the photo electric cell activates and activates the timer. The second apparatus includes an internal ring, a plurality of bulbs removably mounted in, and illuminating through, the internal ring when the timer is activated, a plurality of tube assemblies that depend from, and visually communicate with, the internal ring, a speaker, and an annunciator that audiblizes through the speaker when the timer is activated.

48 Claims, 1 Drawing Sheet

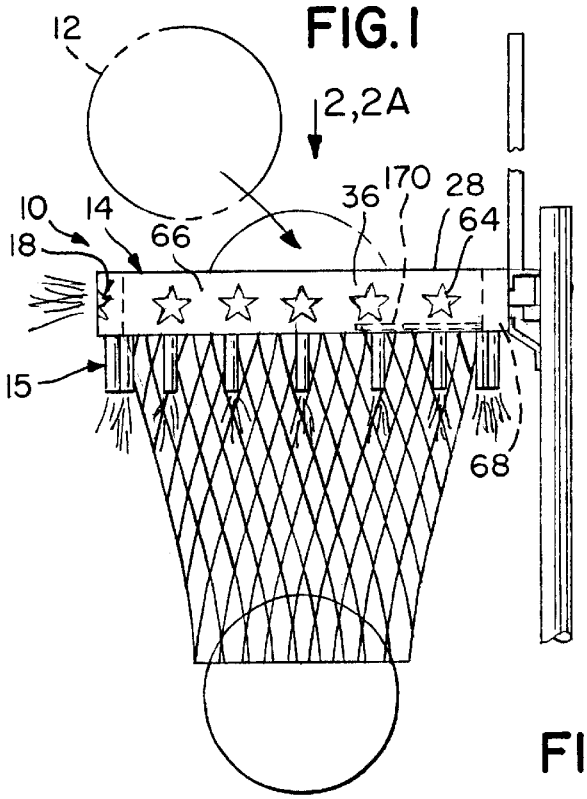
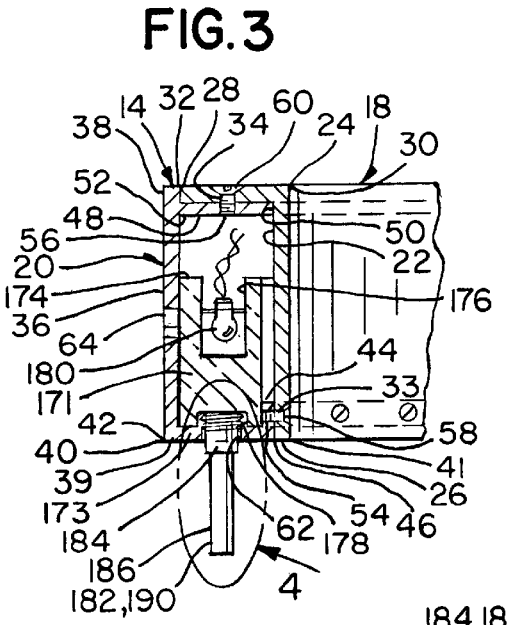
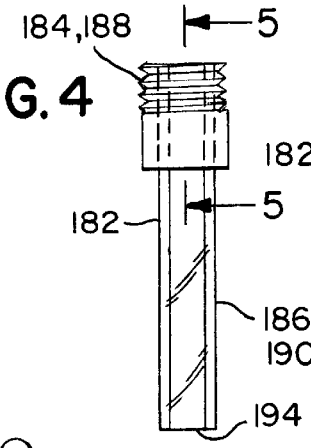
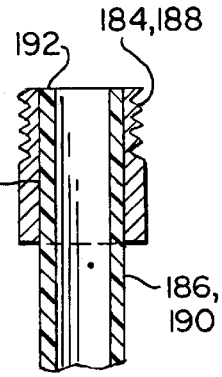
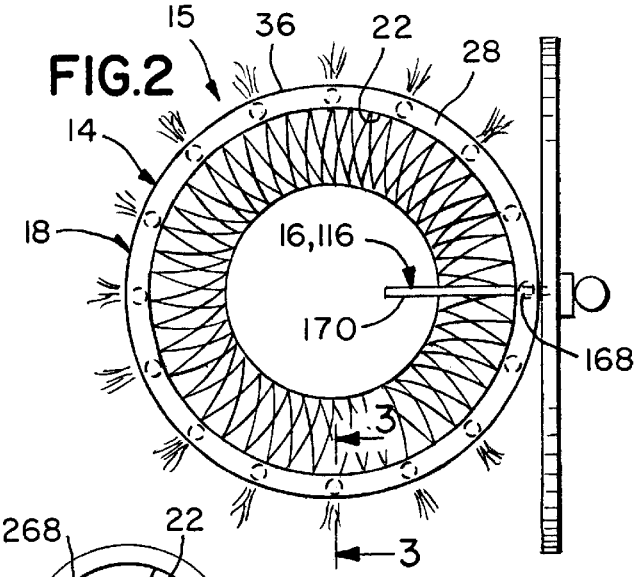
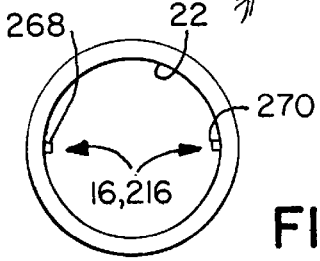
FIG.2A
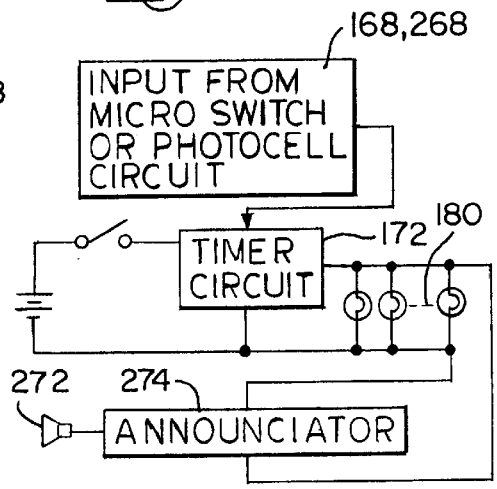
FIG.6

HOOP FOR INDICATING WHEN A BASKETBALL PASSES THERETHROUGH

BACKGROUND OF THE INVENTION

1. Field of the Invention

The present invention relates to a hoop. More particularly, the present invention relates to a hoop for indicating when a basketball passes therethrough.

2. Description of the Prior Art

Numerous innovations for target indicators have been provided in the prior art that will be described. Even though these innovations may be suitable for the specific individual purposes to which they address, however, they differ from the present invention.

A FIRST EXAMPLE, U.S. Pat. No. 4,013,292 to Cohen et al. teaches a basketball game having a coin operated switch to release basketballs to a player and to initiate a timing circuit. The player attempts to convert as many baskets as possible during the time interval of the game. The basketball hoop has means to indicate when a score has been made. Visual display means are provided to indicate the score made, the time interval remaining in which the player can attempt to score and the number of successfully won games. In one embodiment, the games ends when the time interval expires. In another embodiment, the games ends when the time interval expires or when a predetermined number of balls have been thrown, whichever occurs first. Solid state circuits may reset the game for free rounds of play and control the dispensing of prize tickets as a function of the game score and of the number of successively won games.

A SECOND EXAMPLE, U.S. Pat. No. 4,148,555 to Lerman teaches a target type scoring device which includes a target formed of a resilient material such as a net supported by elastic members and a frame, there being a trigger positioned behind the target and reciprocally movable toward and away therefrom. A cam and cam follower arrangement interconnect the trigger and an indicia or score indicating display causing the display to rotate upon actuation of the trigger by an object thrown against the target in a scoring area.

A THIRD EXAMPLE, U.S. Pat. No. 5,064,195 to McMahan et al. teaches a novelty basketball goal producing a predetermined pattern of sound effects, such as crowd cheers and applause, responsive to a made shot. The goal includes a force activated sensor suspended within the net of the goal by the wires which connect the sensor to the sound effects generating means. The sensor will contact an object passing through the hoop thereby triggering the sound effects generator. The sensor is preferably a self-contained electrical switch having a housing and two conductors positioned therein. One of the conductors is suspended within the housing so that a force applied thereto causes the conductor of the switch to come into electrical contact. An inexpensive and readily manufactured novelty basketball goal with sound effects is provided by the simple force activated sensing arrangement. The backboard of the goal may include a clip for mounting to a vertical surface, such as the rim of a waste paper basket. The hoop may also be pivotally connected to the backboard so that the hoop may be folded against the backboard to facilitate storage and carrying of the goal.

A FOURTH EXAMPLE, U.S. Pat. No. 5,813,928 to Hsieh teaches a ball basket that comprises an attachment loop, a net and a sensing unit. The net is fastened at one end thereof with the attachment loop which is in turn fastened with a goal frame. The sensing unit is composed of a connection string and a sensing body connected with the connection string fastened with the net. The sensing body is provided with an oscillatory power switch for controlling an audio-photo element capable of bringing about an audio-photo effect at such time when the sensing body is impacted by a ball.

A FIFTH EXAMPLE, U.S. Pat. No. 5,833,558 to Pettle teaches a lighted basketball goal encompassing a lighted flexible member situated about the perimeter of the basketball rim. This lighted flexible member is situated at a predetermined position so as not to interfere with the basketball, and so as not to be jarred or damaged by said basketball. The power supply coupling to the flexible lighting element is further characterized by a quick connect mechanism. A method for lighting an existing basketball goal comprising the installation of a flexible lighted member about the perimeter of a basketball rim at a predetermined position as not to interfere with the basketball, or be jarred or damaged by said basketball.

It is apparent that numerous innovations for target indicators have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hoop for indicating when a basketball passes therethrough that avoids the disadvantages of the prior art.

ANOTHER OBJECT of the present invention is to provide a hoop for indicating when a basketball passes therethrough that is simple and inexpensive to manufacture.

STILL ANOTHER OBJECT of the present invention is to provide a hoop for indicating when a basketball passes therethrough that is simple to use.

BRIEFLY STATED, STILL YET ANOTHER OBJECT of the present invention is to provide a hoop for indicating when a basketball passes therethrough that includes a ring and first and second apparatuses. In a first embodiment, the first apparatus includes a momentary microswitch, a lever that closes the microswitch when contacted by the basketball, and a timer that activates when the momentary switch is closed. In a second embodiment, the first apparatus includes a light source and a photo electric cell that receives a beam of light from the light source. When the beam of light is broken by the basketball, the photo electric cell activates and activates the timer. The second apparatus includes an internal ring, a plurality of bulbs removably mounted in, and illuminating through, the internal ring when the timer is activated, a plurality of tube assemblies that depend from, and visually communicate with, the internal ring, a speaker, and an annunciator that audiblizes through the speaker when the timer is activated.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

DESCRIPTION OF THE DRAWING

The figures of the drawing are briefly described as follows:

FIG. 1 is a diagrammatic side elevational view of the present invention in use;

FIG. 2 is a diagrammatic top plan view taken generally in the direction of arrow 2 in FIG. 1;

FIG. 2A is a diagrammatic top plan view taken generally in the direction of arrow 2A in FIG. 1;

FIG. 3 is an enlarged diagrammatic cross sectional view taken on line 3—3 in FIG. 2;

FIG. 4 is an enlarged diagrammatic side elevational view of the area generally enclosed by the dotted curve identified by arrow 4 in FIG. 3;

FIG. 5 is an enlarged diagrammatic cross sectional view taken on line 5—5 in FIG. 4; and FIG. 6 is a schematic diagram of the circuit of the present invention.

LIST OF REFERENCE NUMERALS UTILIZED IN THE DRAWING

10 hoop of present invention for indicating when basketball 12 passes therethrough
12 basketball
14 ring for having basketball 12 pass therethrough
15 indicating apparatus for indicating when basketball 12 passes through ring 14
16 triggering apparatus for activating when basketball 12 passes through ring 14
18 inner ring of ring 14
20 outer ring of ring 14
22 vertical wall of inner ring 18 of ring 14
24 uppermost terminal edge of vertical wall 22 of inner ring 18 of ring 14
26 lowermost terminal edge of vertical wall 22 of inner ring 18 of ring 14
28 horizontal wall of inner ring of ring 14
30 innermost terminal edge of horizontal wall 28 of inner ring 18 of ring 14
32 outermost terminal edge of horizontal wall 28 of inner ring 18 of ring 14
33 plurality of throughbores in vertical wall 22 of inner ring 18 of ring 14
34 plurality of throughbores in horizontal wall 28 of inner ring 18 of ring 14
36 outermost vertical wall of outer ring 20 of ring 14
38 uppermost terminal edge of outermost vertical wall 36 of outer ring 20 of ring 14
39 lowermost horizontal wall of outer ring 20 of ring 14
40 lowermost terminal edge of outermost vertical wall 36 of outer ring 20 of ring 14
41 innermost terminal edge of lowermost horizontal wall 39 of outer ring 20 of ring 14
42 outermost terminal edge of lowermost horizontal wall 39 of outer ring 20 of ring 14
44 innermost vertical wall of outer ring 20 of ring 14
46 lowermost terminal edge of innermost vertical wall 44 of outer ring 20 of ring 14
48 uppermost horizontal wall of outer ring 20 of ring 14
50 innermost terminal edge of uppermost horizontal wall 48 of outer ring 20 of ring 14
52 outermost terminal edge of uppermost horizontal wall 48 of outer ring 20 of ring 14
53 recessed ledge defined by outermost vertical wall 36 of outer ring 20 of ring 14 and uppermost horizontal wall 48 of outer ring 20 of ring 14
54 plurality of throughbores in innermost vertical wall 44 of outer ring 20 of ring 14
56 plurality of throughbores in uppermost horizontal wall 48 of outer ring 20 of ring 14
58 first plurality of screws of ring 14
60 second plurality of screws of ring 14
62 plurality of throughbores in lowermost horizontal wall 39 of outer ring 20 of ring 14
64 plurality of throughbores in outermost vertical wall 36 of outer ring 20 of ring 14
66 fluorescent coating of ring 14

First Embodiment of Triggering Apparatus 116

116 triggering apparatus
168 momentary microswitch of triggering apparatus 116
170 lever of triggering apparatus 116
172 timer of triggering apparatus 116

Second Embodiment of Triggering Apparatus 216

216 triggering apparatus
268 light source of triggering apparatus 216
270 photo electric cell of triggering apparatus 216

First Embodiment of Indicating Apparatus 115

115 indicating apparatus
171 internal ring of indicating apparatus 115
173 lowermost horizontal surface of internal ring 171 of indicating apparatus 115
174 uppermost horizontal surface of internal ring 171 of indicating apparatus 115
176 plurality of blindbores in uppermost horizontal surface 174 of internal ring 171 of indicating apparatus 115
178 plurality of blindbores in lowermost surface 173 of internal ring 171 of indicating apparatus 115
180 plurality of bulbs of indicating apparatus 115
182 plurality of tube assemblies of indicating apparatus 115
184 upper portions of plurality of tube assemblies 182 of indicating apparatus 115
186 lower portions of plurality of tube assemblies 182 of indicating apparatus 115
188 externally threaded bushings of upper portions 184 of plurality of tube assemblies 182 of indicating apparatus 115
190 tubes of lower portions 186 of plurality of tube assemblies 182 of indicating apparatus 115
192 uppermost ends of tubes 190 of lower portions 186 of plurality of tube assemblies 182 of indicating apparatus 115
194 free ends of tubes 190 of lower portions 186 of plurality of tube assemblies 182 of indicating apparatus 115

Second Embodiment of Indicating Apparatus 215

215 indicating apparatus
272 speaker of indicating apparatus 215
274 annunciator of indicating apparatus 215

DESCRIPTION OF THE PREFERRED EMBODIMENT

Referring now to the figures, in which like numerals indicate like parts, and particularly to FIG. 1, the hoop of the present invention is shown generally at 10 for indicating when a basketball 12 passes therethrough.

The general configuration of the hoop 10 can best be seen in FIGS. 1 and 2, and as such, will be discussed with reference thereto.

The hoop 10 comprises a ring 14 for having the basketball 12 pass therethrough and triggering apparatus 16 that is operatively connected to the ring 14 and is for activating when the basketball 12 passes through the ring 14.

The hoop 19 further comprises indicating apparatus 15 that is operatively connected to the triggering apparatus 16 and is for indicating when the basketball 12 passes through the ring 14.

The specific configuration of the ring 14 can best be seen in FIGS. 1–3, and as such, will be discussed with reference thereto.

The ring 14 comprises an inner ring 18 and an outer ring 20 that is replaceably and concentrically attached to the inner ring 18.

The inner ring 18 is inverted L-shaped in lateral cross section.

The inner ring 18 has a vertical wall 22 that is cylindrically-shaped.

The vertical wall 22 of the inner ring 18 has an uppermost terminal edge 24 that is circular-shaped and a lowermost terminal edge 26 that is circular-shaped.

The inner ring 18 further has a horizontal wall 28 that is flat and donut-shaped.

The horizontal wall 28 of the inner ring 18 has an innermost terminal edge 30 that is circular-shaped and an outermost terminal edge 32 that is circular-shaped and concentric and coplanar with the innermost terminal edge 30 of the horizontal wall 28 of the inner ring 18.

The innermost terminal edge 30 of the horizontal wall 28 of the inner ring 18 is coincident with the uppermost terminal edge 24 of the vertical wall 22 of the inner ring 18, with the horizontal wall 28 of the inner ring 18 extending perpendicularly and radially outwardly from the vertical wall 22 of the inner ring 18.

The vertical wall 22 of the inner ring 18 further has a plurality of throughbores 33 that extend horizontally therethrough and are spaced circumferentially therearound.

The plurality of throughbores 33 in the vertical wall 22 of the inner ring 18 are disposed in close proximity to the lowermost terminal edge 26 of the vertical wall 22 of the inner ring 18.

The horizontal wall 28 of the inner ring 18 further has a plurality of throughbores 34 that extend vertically therethrough and are spaced circumferentially therearound.

The plurality of throughbores 34 in the horizontal wall 28 of the inner ring 18 are disposed midway between the outermost terminal edge 32 of the horizontal wall 28 of the inner ring 18 and the innermost terminal edge 30 of the horizontal wall 28 of the inner ring 18.

The outer ring 20 is substantially C-shaped in lateral cross section.

The outer ring 20 has an outermost vertical wall 36 that is cylindrically-shaped.

The outermost vertical wall 36 of the outer ring 20 has an uppermost terminal edge 38 that is circular-shaped and a lowermost terminal edge 40 that is circular-shaped.

The outer ring 20 further has a lowermost horizontal wall 39 that is flat and donut-shaped.

The lowermost horizontal wall 39 of the outer ring 20 has an innermost terminal edge 41 that is circular-shaped and an outermost terminal edge 42 that is circular-shaped and concentric and coplanar with the innermost terminal edge 41 of the lowermost horizontal wall 39 of the outer ring 20.

The outermost terminal edge 42 of the lowermost horizontal wall 39 of the outer ring 20 is coincident with the lowermost terminal edge 40 of the outermost vertical wall 36 of the outer ring 20, with the lowermost horizontal wall 39 of the outer ring 20 extending perpendicularly and radially inwardly from the outermost vertical wall 36 of the outer ring 20.

The outer ring 20 further has an innermost vertical wall 44 that is cylindrically-shaped.

The innermost vertical wall 44 of the outer ring 20 has a lowermost terminal edge 46 that is circular-shaped.

The lowermost terminal edge 46 of the innermost vertical wall 44 of the outer ring 20 is coincident with the innermost terminal edge 41 of the lowermost horizontal wall 39 of the outer ring 20, with the innermost vertical wall 44 of the outer ring 20 extending perpendicularly upwardly from the lowermost horizontal wall 39 of the outer ring 20 and abutting directly against the vertical wall 22 of the inner ring 18.

The outer ring 20 further has an uppermost horizontal wall 48 that is flat and donut-shaped.

The uppermost horizontal wall 48 of the outer ring 20 has an innermost terminal edge 50 that is circular-shaped and an outermost terminal edge 52 that is circular-shaped and concentric and coplanar with the innermost terminal edge 50 of the uppermost horizontal wall 48 of the outer ring 20.

The uppermost horizontal wall 48 of the outer ring 20 extends perpendicularly and radially inwardly from the outermost vertical wall 36 of the outer ring 20, with the innermost terminal edge of the uppermost horizontal wall 48 of the outer ring 20 abutting directly against the vertical wall 22 of the inner ring 18, with the outermost terminal edge 52 of the uppermost horizontal wall 48 of the outer ring 20 being disposed just below the uppermost terminal edge 38 of the outermost vertical wall 36 of the outer ring 20 so as to form a recessed ledge 53 that is defined by the outermost vertical wall 36 of the outer ring 20 and the uppermost horizontal wall 48 of the outer ring 20 that receives the horizontal wall 28 of the inner ring 18, with the horizontal wall 28 of the inner ring 18 resting directly on the uppermost horizontal wall 48 of the outer ring 20, and with the outermost terminal edge 32 of the horizontal wall 28 of the inner ring 18 abutting directly against the uppermost terminal edge 38 of the outermost vertical wall 36 of the outer ring 20.

The innermost vertical wall 44 of the outer ring 20 further has a plurality of throughbores 54 that extend horizontally therethrough and are spaced circumferentially therearound.

The plurality of throughbores 54 in the innermost vertical wall 44 of the outer ring 20 are disposed in close proximity to the lowermost terminal edge 46 of the innermost vertical wall 44 of the outer ring 20.

The plurality of throughbores 54 in the innermost vertical wall 44 of the outer ring 20 are aligned with the plurality of throughbores 33 in the vertical wall 22 of the inner ring 18, respectively.

The uppermost horizontal wall 48 of the outer ring 20 further has a plurality of throughbores 56 that extend vertically therethrough and are spaced circumferentially therearound.

The plurality of throughbores 56 in the uppermost horizontal wall 48 of the outer ring 20 are disposed midway between the outermost terminal edge 52 of the uppermost horizontal wall 48 of the outer ring 20 and the innermost terminal edge 50 of the uppermost horizontal wall 48 of the outer ring 20.

The plurality of throughbores 56 in the uppermost horizontal wall 48 of the outer ring 20 are aligned with the plurality of throughbores 34 in the horizontal wall 28 of the inner ring 18, respectively.

The ring 14 further comprises a first plurality of screws 58 that extend into the plurality of throughbores 33 in the vertical wall 22 of the inner ring 18 and the plurality of throughbores 54 in the innermost vertical wall 44 of the outer ring 20, respectively, so as to replaceably maintain the outer ring 20 onto the inner ring 18.

The ring 14 further comprises a second plurality of screws 60 that extend into the plurality of throughbores 34 in the horizontal wall 28 of the inner ring 18 and the plurality of throughbores 56 in the uppermost horizontal wall 48 of the outer ring 20, respectively, so as to replaceably maintain the outer ring 20 onto the inner ring 18.

The lowermost horizontal wall 39 of the outer ring 20 further has a plurality of throughbores 62 that extend vertically therethrough and are spaced circumferentially therearound.

The plurality of throughbores 62 in the lowermost horizontal wall 39 of the outer ring 20 are disposed midway between the outermost terminal edge 40 of the lowermost horizontal wall 39 of the outer ring 20 and the innermost terminal edge 41 of the lowermost horizontal wall 39 of the outer ring 20.

The outermost vertical wall 36 of the outer ring 20 further has a plurality of throughbores 64 that extend horizontally therethrough and are spaced circumferentially therearound.

The plurality of throughbores 64 in the outermost vertical horizontal wall 36 of the outer ring 20 are disposed midway between the uppermost terminal edge 38 of the outermost vertical horizontal wall 36 of the outer ring 20 and the lowermost terminal edge 40 of the outermost vertical wall 36 of the outer ring 20.

The plurality of throughbores 64 in the outermost vertical horizontal wall 36 of the outer ring 20 are star-shaped.

The ring 14 further comprises a fluorescent coating 66 that covers the outermost vertical horizontal wall 36 of the outer ring 20 so as to allow the ring 14 to shine in the dark.

The specific configuration of a first embodiment of the triggering apparatus 116 can best be seen in FIGS. 1, 2, and 6, and as such, will be discussed with reference thereto.

The triggering apparatus 116 comprises a momentary microswitch 168 that is attached to the vertical wall 22 of the inner ring 18.

The triggering apparatus 116 further comprises a lever 170 that is pivotally connected to the momentary microswitch 168.

The lever 170 extends radially inwardly from the momentary microswitch 168 into the inner ring 18 a distance sufficient for being contacted by the basketball 12 when the basketball 12 passes through the ring 14, and when contacted, pivots downwardly and closes the momentary microswitch 168 and then pivots back upwardly opening the momentary microswitch 168.

The triggering apparatus 116 further comprises a timer 172 that is in electrical communication with the momentary microswitch 168, and activates when the momentary switch 168 closes momentarily, and when activated, activates the indicating apparatus 15 for a preselected period of time.

The specific configuration of a second embodiment of the triggering apparatus 216 can best be seen in FIGS. 2A and 6, and as such, will be discussed with reference thereto.

The triggering apparatus 216 is similar to the triggering apparatus 116, except that the momentary microswitch 168 and the lever 170 are replaced with a light source 268 that is attached to the vertical wall 22 of the inner ring 18 and generates a beam of light and a photo electric cell 270 that is attached to the vertical wall 22 of the inner ring 18, diametrically opposite to the light source 268, is in electrical communication with the timer 172, and receives the beam of light from the light source 268, and when the beam of light is broken by the basketball 12, the photo electric cell 270 activates momentary and then deactivates.

The specific configuration of a first embodiment of the indicating apparatus 115 can best be seen in FIGS. 3–6, and as such, will be discussed with reference thereto.

The indicating apparatus 115 comprises an internal ring 171 that is disposed in the outer ring 20.

The internal ring 171 extends radially from the outermost vertical wall 36 of the outer ring 20 to the innermost vertical wall 44 of the outer ring 20 and vertically, at a lowermost horizontal surface 173 thereof, from the lowermost horizontal wall 39 of the outer ring 20 to an uppermost horizontal surface 174 thereof that is spaced below the uppermost horizontal wall 48 of the outer ring 20.

The internal ring 171 is transparent and visually communicates with the plurality of throughbores 64 in the outermost vertical horizontal wall 36 of the outer ring 20.

The uppermost horizontal surface 174 of the internal ring 171 has a plurality of blindbores 176 that depend vertically therein and are spaced circumferentially therearound.

The lowermost surface 173 of the internal ring 171 has a plurality of blindbores 178 that extend vertically therein, are spaced circumferentially therearound, are threaded, are in communicating alignment with the plurality of throughbores 62 in the lowermost horizontal wall 39 of the outer ring 20, respectively, and are in visual alignment with the plurality of blindbores 176 in the uppermost horizontal surface 174 of the internal ring 171.

The indicating apparatus 115 further comprises a plurality of bulbs 180 that are removably mounted in the plurality of blindbores 176 in the uppermost horizontal surface 174 of, and visually communicate with, the internal ring 171, respectively, and are in electrical communication with the timer 171 so as to illuminate through the plurality of throughbores 64 in the outermost vertical horizontal wall 36 of the outer ring 20 when the timer 172 is activated.

The indicating apparatus 115 further comprises a plurality of tube assemblies 182 that comprise upper portions 184 and lower portions 186.

The upper portions 184 of the plurality of tube assemblies 182 are externally threaded bushings 188 that extend freely up into the plurality of throughbores 62 in the lowermost horizontal wall 39 of the outer ring 20, respectively, and threadably up into the plurality of blindbores 178 in the lowermost surface 173 of the internal ring 171, respectively.

The lower portions 186 of the plurality of tube assemblies 182 ate tubes 190 that have uppermost ends 192 that are force fitted into the externally threaded bushings 188, respectively, with the tubes 190 depending therefrom to past the lowermost horizontal wall 39 of the outer ring 20, to free ends 194.

The lower portions 186 of the plurality of tubes assemblies 182 are transparent and visually communicate with the internal ring 171 so as to allow the plurality of bulbs 180 to illuminate therethrough when the timer 172 is activated.

The specific configuration of a second embodiment of the indicating apparatus 215 can best be seen in FIG. 6, and as such, will be discussed with reference thereto.

The indicating apparatus 215 comprises a speaker 272 that is in electrical communication with the timer 172 and an annunciator 274 that is in electrical communication with the timer 172 and the speaker 272, and audiblizes through the speaker 272 when the timer 172 is activated.

It will be understood that each of the elements described above, or two or more together, may also find a useful application in other types of constructions differing from the types described above.

While the invention has been illustrated and described as embodied in a hoop for indicating when a basketball passes therethrough, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hoop for indicating when a basketball passes therethrough, comprising:

a) a ring; and c) first means for activating when the basketball passes through said ring; and wherein said ring is for having the basketball pass therethrough, wherein said ring comprises an inner ring;

wherein said ring comprises an outer ring;

wherein said outer ring is replaceably attached to said inner ring; and wherein said outer ring is concentrically attached to said inner ring, wherein said inner ring has a vertical wall; and wherein said vertical wall of said inner ring is cylindrically-shaped, wherein said vertical wall of said inner ring has an uppermost terminal edge;

wherein said uppermost terminal edge of said vertical wall of said inner ring is circular-shaped;

wherein said vertical wall of said inner ring has a lowermost terminal edge; and wherein said lowermost terminal edge of said vertical wall of said inner ring is circular-shaped, wherein said inner ring has a horizontal wall;

wherein said horizontal wall of said inner ring is flat; and wherein said horizontal wall of said inner ring is donut-shaped, wherein said horizontal wall of said inner ring has an innermost terminal edge;

wherein said innermost terminal edge of said horizontal wall of said inner ring is circular-shaped;

wherein said horizontal wall of said inner ring has an outermost terminal edge;

wherein said outermost terminal edge of said horizontal wall of said inner ring is circular-shaped;

wherein said outermost terminal edge of said horizontal wall of said inner ring is concentric with said innermost terminal edge of said horizontal wall of said inner ring; and wherein said outermost terminal edge of said horizontal wall of said inner ring is coplanar with said innermost terminal edge of said horizontal wall of said inner ring, wherein said vertical wall of said inner ring has a plurality of throughbores;

wherein said plurality of throughbores in said vertical wall of said inner ring extend horizontally through said vertical wall of said inner ring; and wherein said plurality of throughbores in said vertical wall of said inner ring are spaced circumferentially around said vertical wall of said inner ring, wherein said plurality of throughbores in said vertical wall of said inner ring, are disposed in close proximity to said lowermost terminal edge of said vertical wall of said inner ring.

2. The hoop as defined in claim 1; further comprising second means for indicating when the basketball passes through said ring.

3. The hoop as defined in claim 1, wherein said inner ring is inverted L-shaped in lateral cross section.

4. The hoop as defined in claim 1, wherein said innermost terminal edge of said horizontal wall of said inner ring is coincident with said uppermost terminal edge of said vertical wall of said inner ring;

wherein said horizontal wall of said inner ring extends perpendicularly from said vertical wall of said inner ring; and wherein said horizontal wall of said inner ring extends radially outwardly from said vertical wall of said inner ring.

5. The hoop as defined in claim 1, wherein said horizontal wall of said inner ring has a plurality of throughbores;

wherein said plurality of throughbores in said horizontal wall of said inner ring extend vertically through said horizontal wall of said inner ring; and wherein said plurality of throughbores in said horizontal wall of said inner ring are spaced circumferentially around said horizontal wall of said inner ring.

6. The hoop as defined in claim 5, wherein said plurality of throughbores in said horizontal wall of said inner ring are disposed midway between said outermost terminal edge of said horizontal wall of said inner ring and said innermost terminal edge of said horizontal wall of said inner ring.

7. The hoop as defined in claim 1, wherein said outer ring is substantially C-shaped in lateral cross section.

8. The hoop as defined in claim 5, wherein said outer ring has an outermost vertical wall; and wherein said outermost vertical wall of said outer ring is cylindrically-shaped.

9. The hoop as defined in claim 8, wherein said outermost vertical wall of said outer ring has an uppermost terminal edge;

wherein said uppermost edge of said outermost vertical wall of said outer ring is circular-shaped;

wherein said outermost vertical wall of said outer ring has a lowermost terminal edge; and wherein said lowermost edge of said outermost vertical wall of said outer ring is circular-shaped.

10. The hoop as defined in claim 9, wherein said outer ring has a lowermost horizontal wall;

wherein said lowermost wall of said outer ring is flat; and wherein said lowermost wall of said outer ring is donut-shaped.

11. The hoop as defined in claim 10, wherein said lowermost horizontal wall of said outer ring has an innermost terminal edge;

wherein innermost terminal edge of said lowermost horizontal wall of said outer ring is circular-shaped;

wherein said lowermost horizontal wall of said outer ring has an outermost terminal edge;

wherein said outermost terminal edge of said lowermost horizontal wall of said outer ring is circular-shaped;

wherein said outermost terminal edge of said lowermost horizontal wall of said outer ring is concentric with said innermost terminal edge of said lowermost horizontal wall of said outer ring; and wherein said outermost terminal edge of said lowermost horizontal wall of said outer ring is coplanar with said innermost terminal edge of said lowermost horizontal wall of said outer ring.

12. The hoop as defined in claim 11, wherein said outermost terminal edge of said lowermost horizontal wall of said outer ring is coincident with said lowermost terminal edge of said outermost vertical wall of said outer ring;

wherein said lowermost horizontal wall of said outer ring extends perpendicularly from said outermost vertical wall of said outer ring; and wherein said lowermost horizontal wall of said outer ring extends radially inwardly from said outermost vertical wall of said outer ring.

13. The hoop as defined in claim 11, wherein said outer ring has a innermost vertical wall; and wherein said innermost vertical wall of said outer ring is cylindrically-shaped.

14. The hoop as defined in claim 13, wherein said innermost vertical wall of said outer ring has a lowermost terminal edge; and wherein said lowermost terminal edge of said innermost vertical wall of said outer ring is circular-shaped.

15. The hoop as defined in claim 14, wherein said lowermost terminal edge of said innermost vertical wall of said outer ring is coincident with said innermost terminal edge of said lowermost horizontal wall of said outer ring;

wherein said innermost vertical wall of said outer ring extends perpendicularly from said lowermost horizontal wall of said outer ring;

wherein said innermost vertical wall of said outer ring extends upwardly from said lowermost horizontal wall of said outer ring; and wherein said innermost vertical wall of said outer ring abuts directly against said vertical wall of said inner ring.

16. The hoop as defined in claim 13, wherein said outer ring has an uppermost horizontal wall;

wherein said uppermost horizontal wall of said outer ring is flat; and wherein said uppermost horizontal wall of said outer ring is donut-shaped.

17. The hoop as defined in claim 16, wherein said uppermost horizontal wall of said outer ring has an innermost terminal edge;

wherein said innermost terminal edge of said uppermost horizontal wall of said outer ring is circular-shaped;

wherein said uppermost horizontal wall of said outer ring has an outermost terminal edge;

wherein said outermost terminal edge of said uppermost horizontal wall of said outer ring is circular-shaped;

wherein said outermost terminal edge of said uppermost horizontal wall of said outer ring is concentric with said innermost terminal edge of said uppermost horizontal wall of said outer ring; and wherein said outermost terminal edge of said uppermost horizontal wall of said outer ring is coplanar with said innermost terminal edge of said uppermost horizontal wall of said outer ring.

18. The hoop as defined in claim 17, wherein said uppermost horizontal wall of said outer ring extends perpendicularly from said outermost vertical wall of said outer ring;

wherein said uppermost horizontal wall of said outer ring extends inwardly from said outermost vertical wall of said outer ring;

wherein said innermost terminal edge of said uppermost horizontal wall of said outer ring abuts directly against said vertical wall of said inner ring;

wherein said outermost terminal edge of said uppermost horizontal wall of said outer ring is disposed just below said uppermost terminal edge of said outermost vertical wall of said outer ring so as to form a recessed ledge;

wherein said recessed ledge of said outer ring is defined by said outermost vertical wall of said outer ring and said uppermost horizontal wall of said outer ring;

wherein said recessed ledge of said outer ring receives said horizontal wall of said inner ring;

wherein said horizontal wall of said inner ring rests directly on said uppermost horizontal wall of said outer ring; and wherein said outermost terminal edge of said horizontal wall of said inner ring abuts directly against said uppermost terminal edge of said outermost vertical wall of said outer ring.

19. The hoop as defined in claim 14, wherein said innermost vertical wall of said outer ring has a plurality of throughbores;

wherein said plurality of throughbores in said innermost vertical wall of said outer ring extend horizontally through said innermost vertical wall of said outer ring; and wherein said plurality of throughbores in said innermost vertical wall of said outer ring are spaced circumferentially around said innermost vertical wall of said outer ring.

20. The hoop as defined in claim 19, wherein said plurality of throughbores in said innermost vertical wall of said outer ring are disposed in close proximity to said lowermost terminal edge of said innermost vertical wall of said outer ring.

21. The hoop as defined in claim 19, wherein said plurality of throughbores in said innermost vertical wall of said outer ring are aligned with said plurality of throughbores in said vertical wall of said inner ring, respectively.

22. The hoop as defined in claim 17, wherein said uppermost horizontal wall of said outer ring has a plurality of throughbores;

wherein said plurality of throughbores in said uppermost horizontal wall of said outer ring extend vertically through said uppermost horizontal wall of said outer ring; and wherein said plurality of throughbores in said uppermost horizontal wall of said outer ring are spaced circumferentially around said uppermost horizontal wall of said outer ring.

23. The hoop as defined in claim 22, wherein said plurality of throughbores in said uppermost horizontal wall of said outer ring are disposed midway between said outermost terminal edge of said uppermost horizontal wall of said outer ring and said innermost terminal edge of said uppermost horizontal wall of said outer ring.

24. The hoop as defined in claim 22, wherein said plurality of throughbores in said uppermost horizontal wall of said outer ring are aligned with said plurality of throughbores in said horizontal wall of said inner ring, respectively.

25. The hoop as defined in claim 19, wherein said ring comprises a first plurality of screws; and wherein said first plurality of screws extend into said plurality of throughbores in said vertical wall of said inner ring and said plurality of throughbores in said vertical wall of said outer ring, respectively, so as to replaceably maintain said outer ring onto said inner ring.

26. The hoop as defined in clams 22, wherein said ring comprises a second plurality of screws; and wherein said second plurality of screws extend into said plurality of throughbores in said horizontal wall of said inner ring and said plurality of throughbores in said uppermost horizontal wall of said outer ring so as to replaceably maintain said outer ring onto said inner ring.

27. The hoop as defined in claim 16, wherein said lowermost horizontal wall of said outer ring has a plurality of throughbores;

wherein said plurality of throughbores in said lowermost horizontal wall of said outer ring extend vertically through said lowermost horizontal wall of said outer ring; and wherein said plurality of throughbores in said lowermost horizontal wall of said outer ring are spaced circumferentially around said lowermost horizontal wall of said outer ring.

28. The hoop as defined in claim 27, herein said plurality of throughbores in said lowermost horizontal wall of said outer ring are disposed midway between said outermost terminal edge of said lowermost horizontal wall of said outer ring and said innermost terminal edge of said lowermost horizontal wall of said outer ring.

29. The hoop as defined in claim 27, wherein said outermost vertical wall of said outer ring has a plurality of throughbores;

wherein said plurality of throughbores in said outermost vertical wall of said outer ring extend horizontally through said outermost vertical wall of said outer ring; and wherein said plurality of throughbores in said outermost vertical wall of said outer ring are spaced circumferentially around said outermost vertical wall of said outer ring.

30. The hoop as defined in claim 29, wherein said plurality of throughbores in said outermost vertical horizontal wall of said outer ring are disposed midway between said uppermost terminal edge of said outermost vertical horizontal wall of said outer ring and said lowermost terminal edge of said outermost vertical wall of said outer ring.

31. The hoop as defined in claim 29, wherein said plurality of throughbores in said outermost vertical horizontal wall of said outer ring are star-shaped.

32. The hoop as defined in claim 8, wherein said ring comprises a fluorescent coating; and wherein said fluorescent coating covers said outermost vertical horizontal wall of said outer ring so as to allow said ring to shine in the dark.

33. The hoop as defined in claim 29, wherein said first means includes a momentary microswitch that is attached to said vertical wall of said inner ring.

34. The hoop as defined in claim 33, wherein said first means includes a lever that is pivotally connected to said momentary microswitch.

35. The hoop as defined in claim 34, wherein said lever extends radially inwardly from said momentary microswitch into said inner ring a distance sufficient for being contacted by the basketball when the basketball passes through said ring, and when contacted, pivots downwardly and closes said momentary microswitch, and then pivots back upwardly.

36. The hoop as defined in claim 33, wherein a first apparatus comprises a timer;

wherein said timer is in electrical communication with said momentary microswitch; and wherein said timer activates when said momentary switch is closed, and when activated, activates said second apparatus for a preselected period of time.

37. The hoop as defined in claim 1, wherein a first apparatus comprises a light source;

wherein said first apparatus comprises a photo electric cell;

wherein said first apparatus comprises a timer;

wherein said timer is in electrical communication with said photo electric cell;

wherein said light source is attached to said vertical wall of said inner ring;

wherein said light source generates a beam of light;

wherein said photo electric cell is attached to said vertical wall of said inner ring;

wherein said photo electric cell is diametrically opposite to said light source;

wherein said photo electric cell is in electrical communication with said timer; and wherein said photo electric cell receives said beam of light from said light source, and when said beam of light is broken, said photo electric cell activates said timer which activates said second apparatus for a preselected period of time.

38. The hoop as defined in claim 36, wherein a second apparatus comprises an internal ring; and wherein said internal ring is disposed in said outer ring.

39. The hoop as defined in claim 38, wherein said internal ring extends radially from said outermost vertical wall of said outer ring to said innermost vertical wall of said outer ring;

wherein said internal ring extends vertically, at a lowermost horizontal surface thereof, from said lowermost horizontal wall of said outer ring to an uppermost horizontal surface thereof; and wherein said uppermost horizontal surface of said internal ring is spaced below said uppermost horizontal wall of said outer ring.

40. The hoop as defined in claim 38, wherein said internal ring is transparent; and wherein said internal ring visually communicates with said plurality of throughbores in said outermost vertical horizontal wall of said outer ring.

41. The hoop as defined in claim 39, wherein said uppermost horizontal surface of said internal ring has a plurality of blindbores;

wherein said plurality of blindbores depend vertically in said uppermost horizontal surface of said internal ring; and wherein said plurality of blindbores are spaced circuimferentially around said uppermost horizontal surface of said internal ring.

42. The hoop as defined in claim 41, wherein said lowermost surface of said internal ring has a plurality of blindbores;

wherein said plurality of blindbores extend vertically in said lowermost surface of said internal ring;

wherein said plurality of blindbores are spaced circumferentially around said lowermost surface of said internal ring;

wherein said plurality of blindbores are threaded;

wherein said plurality of blindbores are in communicating alignment with said plurality of throughbores in said lowermost horizontal wall of said outer ring, respectively; and wherein said plurality of blindbores are in visual alignment with said plurality of blindbores in said uppermost horizontal surface of said internal ring.

43. The hoop as defined in claim 42, wherein a second apparatus comprises a plurality of bulbs;

wherein said plurality of bulbs are removably mounted in said plurality of blindbores in said uppermost horizontal surface of said internal ring, respectively;

wherein said plurality of bulbs visually communicate with said internal ring;

wherein said plurality of bulbs are in electrical communication with said timer; and wherein said plurality of bulbs illuminate through said plurality of throughbores in said outermost vertical horizontal wall of said outer ring when said timer is activated.

44. The hoop as defined in claim 43, wherein said second apparatus further comprises a plurality of tube assemblies;

wherein said plurality of tube assemblies comprise upper portions; and wherein said plurality of tube assemblies comprise lower portions.

45. The hoop as defined in claim 44, wherein said upper portions of said plurality of tube assemblies are externally threaded bushings;

wherein said externally threaded bushings extend freely up into said plurality of throughbores in said lowermost horizontal wall of said outer ring, respectively; and wherein said externally threaded bushings extend threadably up into said plurality of blindbores in said lowermost surface of said internal ring, respectively.

46. The hoop as defined in claim 45, wherein said lower portions of said plurality of tube assemblies are tubes;

wherein said tubes have uppermost ends;

wherein said uppermost ends of said tubes are force fitted into said externally threaded bushings, respectively; and wherein said tubes depend from said uppermost ends thereof past said lowermost horizontal wall of said outer ring, to free ends.

47. The hoop as defined in claim 44, wherein said lower portions of said plurality of tubes assemblies are transparent; and wherein said lower portions of said plurality of tubes assemblies visually communicate with said internal ring so as to allow said plurality of bulbs to illuminate therethrough when said timer is activated.

48. The hoop as defined in claim 36, wherein a second apparatus comprises a speaker;

wherein a second apparatus comprises an annunciator;

wherein said speaker is in electrical communication with said timer;

wherein said annunciator is in electrical communication with said timer;

wherein said annunciator is in electrical communication with said speaker; and wherein said annunciator audiblizes through said speaker when said timer is activated.

* * * * *